US011457297B2

(12) United States Patent
Ren et al.

(10) Patent No.: US 11,457,297 B2
(45) Date of Patent: Sep. 27, 2022

(54) SPEAKER LAMP

(71) Applicant: CONSUMER LIGHTING (U.S.), LLC, Norwalk, CT (US)

(72) Inventors: Xiaojun Ren, Shanghai (CN); Kun Xiao, Shanghai (CN); Weihu Chen, Shanghai (CN); Hai Huang, Shanghai (CN)

(73) Assignee: SAVANT TECHNOLOGIES LLC, Norwalk, CT (US)

( * ) Notice: Subject to any disclaimer, the term of this patent is extended or adjusted under 35 U.S.C. 154(b) by 0 days.

(21) Appl. No.: 17/067,632

(22) Filed: Oct. 9, 2020

(65) Prior Publication Data

US 2021/0127188 A1 Apr. 29, 2021

(30) Foreign Application Priority Data

Oct. 28, 2019 (CN) ..... 201911030490.9

(51) Int. Cl.

| | |
|---|---|
| ***H04R 1/02*** | (2006.01) |
| ***F21V 33/00*** | (2006.01) |
| ***F21V 23/02*** | (2006.01) |
| ***F21V 29/70*** | (2015.01) |
| ***F21V 7/00*** | (2006.01) |
| ***F21Y 115/10*** | (2016.01) |

(52) U.S. Cl.

CPC ..... *H04R 1/028* (2013.01); *F21V 7/0008* (2013.01); *F21V 23/023* (2013.01); *F21V 29/70* (2015.01); *F21V 33/0056* (2013.01); *F21Y 2115/10* (2016.08)

(58) Field of Classification Search

CPC .. H04R 1/028; H04R 1/281; H04R 2201/021; H04R 1/2811; F21V 3/00; F21V 33/0056; F21V 23/023; F21V 29/70; F21V 7/0008; F21V 7/041; F21V 23/00; F21V 7/04; F21K 9/232; F21K 9/238; F21Y 2115/10

See application file for complete search history.

(56) References Cited

U.S. PATENT DOCUMENTS

| | | | | |
|---|---|---|---|---|
| 8,506,127 | B2 * | 8/2013 | Russello | F21V 31/005 362/294 |
| 9,784,417 | B1 * | 10/2017 | Springer | F21K 9/237 |
| 2016/0298833 | A1 * | 10/2016 | Lin | F21V 21/30 |
| 2017/0211750 | A1 * | 7/2017 | Yotsumoto | F21K 9/237 |
| 2019/0041050 | A1 * | 2/2019 | Cairns | H05B 45/00 |

* cited by examiner

*Primary Examiner* — Peggy A Neils
(74) *Attorney, Agent, or Firm* — Wood IP LLC

(57) ABSTRACT

The present application discloses a speaker lamp which comprises: a housing is formed with a cavity therein; a radiator is provided within the cavity, and divides the cavity into an upper cavity and a lower cavity; a circuit board is provided within the upper cavity and connected to the radiator, and Light Emitting Diode (LED) light sources are provided on the circuit board; a reflector has an opened upper end and an opened lower end and is hollowed so as to surround a reflector cavity, the lower end of the reflector is connected to the circuit board, and the LED light sources surround an outer side of the reflector; and a speaker is installed at the upper end of the reflector and accommodated within the reflector cavity, wherein within the reflector cavity, a space exists between the speaker and the circuit board. By means of such arrangement, the speaker lamp of the present application is capable of improving lighting efficiency, and improving sound quality.

20 Claims, 5 Drawing Sheets

SPEAKER LAMP

CROSS-REFERENCE TO RELATED APPLICATION

This application claims priority to and the benefit of Chinese Patent Application No. 201911030490.9, filed on Oct. 28, 2019, the entire contents of which are incorporated herein by reference.

TECHNICAL FIELD

The present application generally relates to a field of lamps, and in particular, to a speaker lamp.

BACKGROUND

In prior art, a speaker lamp is generally only a simple combination of a speaker and a lamp, in other words, the speaker is only installed on the lamp and makes a sound by means of remote control and cooperation with other peripheral devices. As to this type of the speaker lamp, a problem of sound quality of the speaker lamp is not considered yet. At the same time, since the speaker occupies a part of space within a light transmitting diffuser, a lighting effect of the lamp is affected to some extent.

SUMMARY

In view of this, the present application provides a speaker lamp in order to overcome the above defects, the speaker lamp has good sound quality and high lighting efficiency in a limited sound cavity volume.

The present application provides a speaker lamp which comprises: a housing is formed with a cavity therein; a radiator is provided within the cavity, and divides the cavity into an upper cavity and a lower cavity; a circuit board is provided within the upper cavity and connected to the radiator, and Light Emitting Diode (LED) light sources are provided on the circuit board; a reflector has an opened upper end and an opened lower end and is hollowed so as to surround a reflector cavity, the lower end of the reflector is connected to the circuit board, and the LED light sources surround an outer side of the reflector; and a speaker is installed at the upper end of the reflector and accommodated within the reflector cavity, wherein within the reflector cavity, a space exists between the speaker and the circuit board. By means of such arrangement, because of the existence of the reflector, the reflector is capable of improving the lighting efficiency, and forming a resonance cavity below the speaker so as to improve a sound effect.

Further, an opening part corresponding to the speaker is provided on the housing, so that sound from the speaker may be transmitted towards the exterior of the speaker lamp via the opening part.

Further, the housing comprises: a main housing which has an opening end and an assembling end opposite to the opening end; a base which is connected at the assembling end of the main housing; and a light transmitting diffuser which has a top end and an opened bottom end, and the bottom end of the diffuser is connected with the opening end of the main housing, wherein an opening part corresponding to the speaker is provided at the top end of the diffuser, so that the sound from the speaker can be transmitted toward the exterior of the speaker lamp via the opening part.

Further, a horizontally extended top end flange is formed at a top end of the speaker, the top end flange is placed on a corresponding accommodating part formed at the upper end of the reflector and hermetically connected to the upper end of the reflector.

Further, a downwards extended circumferential flange is formed at the opening part of the diffuser, wherein the circumferential flange is hermetically connected to the top end flange of the speaker.

Further, the opening end of the main housing is hermetically connected with the bottom end of the diffuser together, so that the cavity within the speaker lamp is formed into a sealed cavity.

Further, the radiator comprises a body part and a circumferential flange downwards extended from a periphery of the body part, and the circumferential flange of the radiator is snapped to an inner wall of the main housing.

Further, the circuit board comprises a first through hole positioned in a center of the circuit board and one or more second through holes arranged along the periphery of the circuit board, and the first through hole and the second through holes are respectively positioned inside and outside of the reflector and separated by the reflector, wherein a communication channel for communicating the first through hole and the second through hole is provided in the body part of the radiator, so that the space within the reflector cavity is communicated to the upper cavity.

Further, a penetration through hole for communicating the upper cavity with the lower cavity is provided in the circumferential flange of the body part.

By means of such arrangement, the space in the sealed cavity may be adequately used to increase the volume of the resonance cavity, thereby a better sound effect is provided.

Further, the speaker lamp further comprises a power supply board which is accommodated in a space surrounded by the circumferential flange of the radiator, wherein a power supply for supplying power to the speaker is provided at a first side of the power supply board.

Further, the speaker lamp further comprises an insulating gasket which is accommodated in the space surrounded by the circumferential flange of the radiator and positioned between the body part and a second side of the power supply board at which the power supply is not installed.

Further, the speaker lamp further comprises a heat sink which is positioned within the lower cavity and connected to the first side of the power supply board.

Further, the speaker lamp further comprises a module board and an antenna which are positioned within the lower cavity and connected to the first side of the power supply board, and the antenna is used for receiving a signal and transmitting the signal to the module board so as to control the speaker.

The present application further provides a speaker lamp which comprises: a base is connected with an external power supply, so as to provide electric power required by the speaker lamp; an outer case is provided on the base; a circuit board is provided within the outer case, and a plurality of LED light sources are provided on the circuit board; a reflector is cylinder-shaped, one end of which is installed on the circuit board and the other end of which is mutually cooperated with an opening formed on the outer case, so as to form a first space positioned within the reflector and a second space positioned between the reflector and the outer case, the LED light sources are positioned within the second space and reflect the light emitted from the LED light sources to external space by the reflector; and a speaker is installed on the reflector and partially accommodated in the first space, wherein a through hole is formed in the circuit board positioned in the first space and the second space, so that the first space is communicated with the second space so as to form a communicated sound cavity.

DETAILED DESCRIPTION OF THE EMBODIMENTS

A solution in the embodiments of the present application is described in detail in combination with the drawings in the embodiments of the present application below. It is to be noted that the embodiments in the present application and features in the embodiments may be mutually combined without conflicting.

Figure 1:
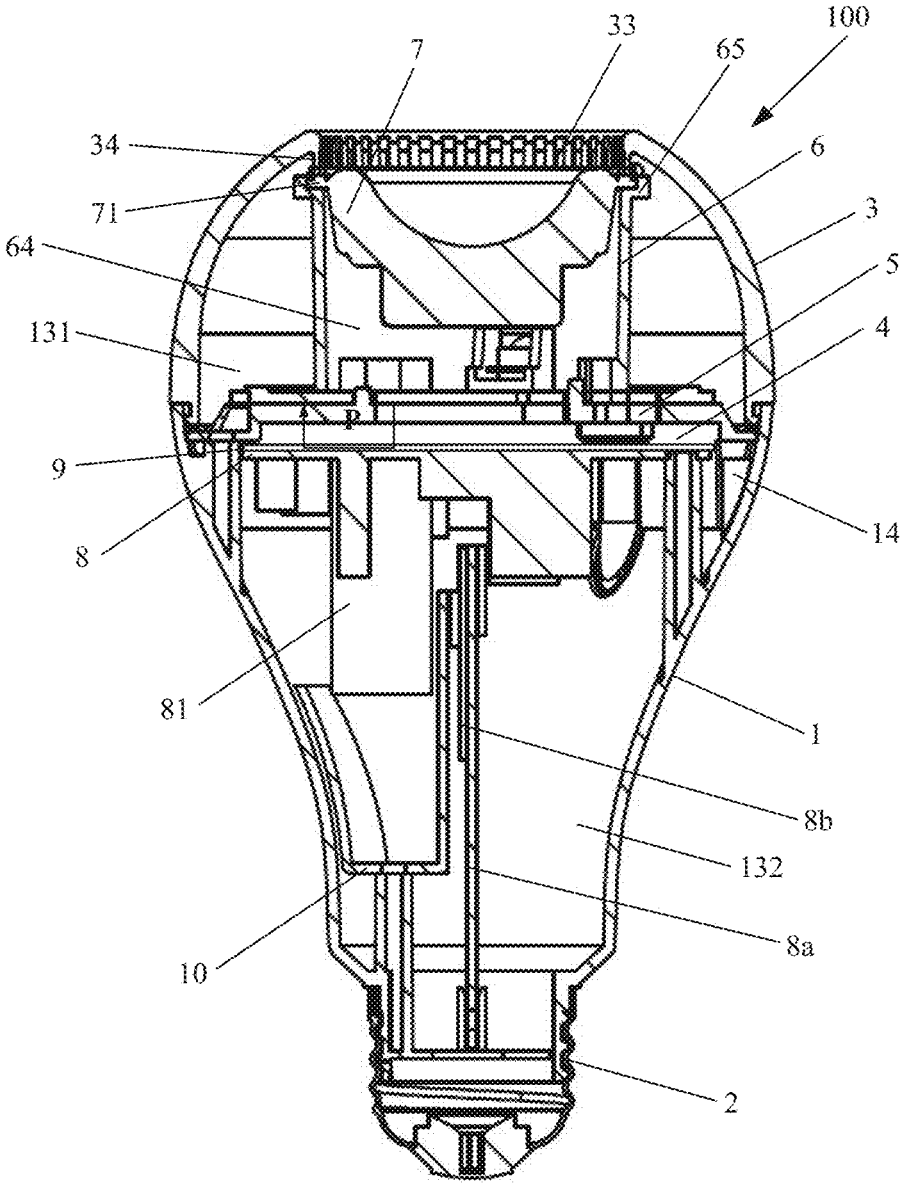
FIG. 1 is a side section view showing a speaker lamp according to an embodiment of the present application.
Figure 2:
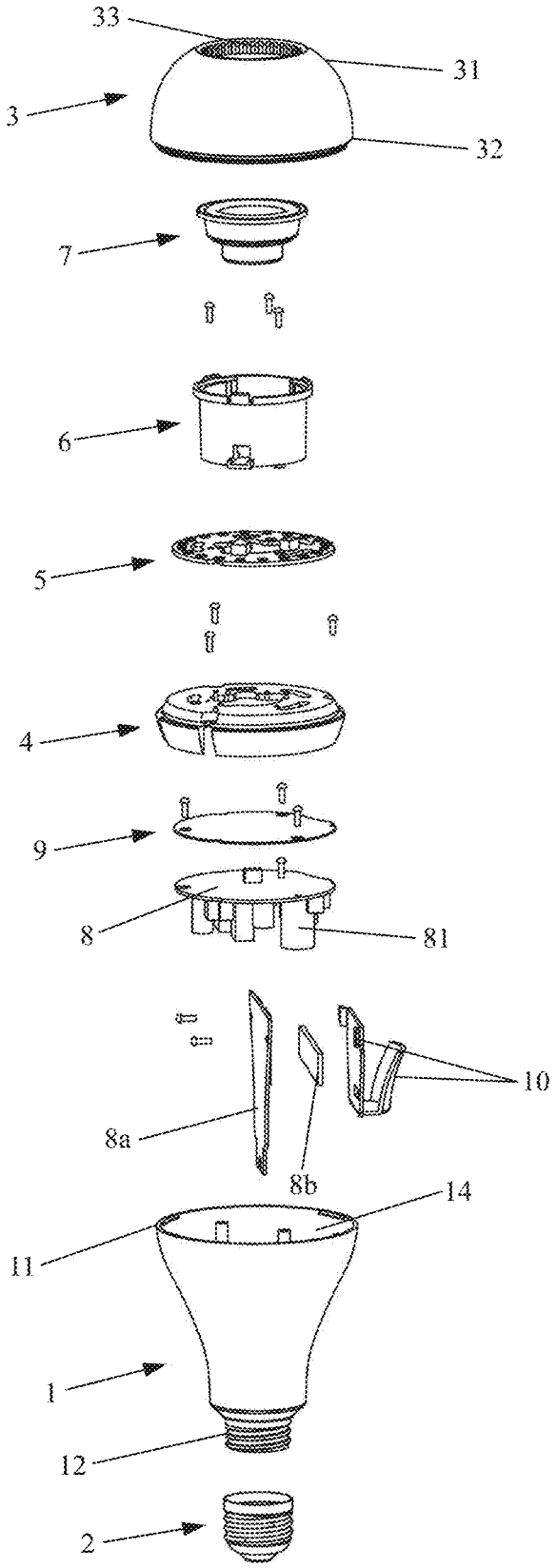
FIG. 2 is an exploded perspective view showing the speaker lamp according to the embodiment of the present application.

By reference to FIGS. 1-6, a speaker lamp 100 according to the embodiment of the present application is shown. The speaker lamp 100 comprises a housing, a form of which is not limited. The housing may be formed by installing a plurality of individual components together as shown in the embodiment of the present application, or may also be integrated. As shown in FIGS. 1-2, the housing of the speaker lamp 100 may comprise a main housing 1, a base 2 and a diffuser 3, wherein the diffuser is made of a light transmitting material. The main housing 1 has an opening end 11 and an assembling end 12 opposite to the opening end 11. The base 2 is connected at the assembling end 12 of the main housing 1. The diffuser 3 has a top end 31 and an opened bottom end 32, and the bottom end 32 of the diffuser 3 is connected with the opening end 11 of the main housing 1. In view of this, in the embodiment of the present application, the main housing 1, the base 2 and the diffuser 3 are connected together so as to form the housing of the speaker lamp 100.

As shown in FIG. 1, a cavity may be formed in the housing.

Figure 5:
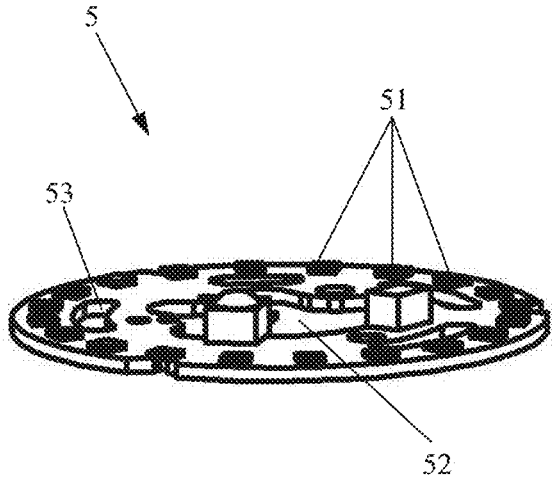
FIG. 5 is a perspective view showing a circuit board of the speaker lamp according to the embodiment of the present application.

The speaker lamp 100 according to the embodiment of the present application may further comprise a radiator 4, a circuit board 5, a reflector 6 and a speaker 7. As shown in FIG. 1, the radiator 4 is provided within the cavity, and divides the cavity into an upper cavity 131 and a lower cavity 132. The circuit board 5 may be provided within the upper cavity 131 and connected to the radiator 4, and one or more LED light sources 51 may be provided on the circuit board 5. The reflector 6 has an opened upper end 61 and an opened lower end 62, and the reflector 6 may be hollowed so as to surround a reflector cavity 63. The lower end 62 of the reflector 6 is connected to the circuit board 5, and the LED light sources 51 surround an outer side of the reflector 6. In the embodiment of the present application, as shown in FIG. 5, a plurality of LED light sources 51 circumferentially arranged around the circumference of the circuit board 5 are provided on the circuit board 5, but a number of and an arrangement form of the LED light sources are not limited to this. The speaker 7 may be installed at the upper end 61 of the reflector 6 and accommodated within the reflector cavity 63.

Specifically, as shown in FIG. 1, within the reflector cavity 63, a space 64 may exist between the speaker 7 and the circuit board 5. By means of such arrangement, a part of light emitted from the LED light source 51 may be reflected by the reflector 6, thereby lighting efficiency of the speaker lamp 100 is reinforced. Furthermore, since the space 64 exists within the reflector 6 below the speaker 7, and the space 64 may achieve the effect of a resonance cavity, the speaker may generate a sound with better tone quality.

As shown in FIGS. 1-2, an opening part 33 corresponding to the speaker 7 is provided on the housing, specifically, the opening part 33 is provided at the top end 31 of the diffuser 3, so that the sound from the speaker 7 may be transmitted towards the exterior of the speaker lamp 100 via the opening part 33.

Figure 3:
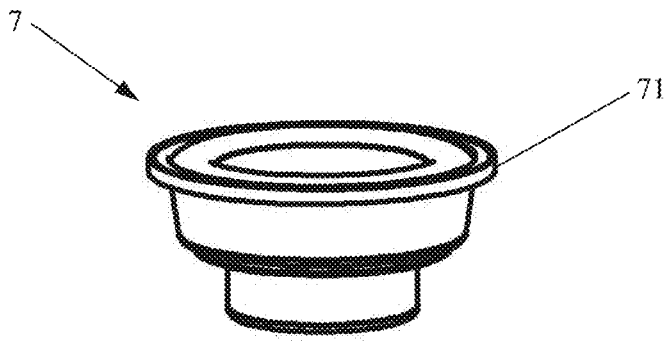
FIG. 3 is a perspective view showing a speaker of the speaker lamp according to the embodiment of the present application.
Figure 4:
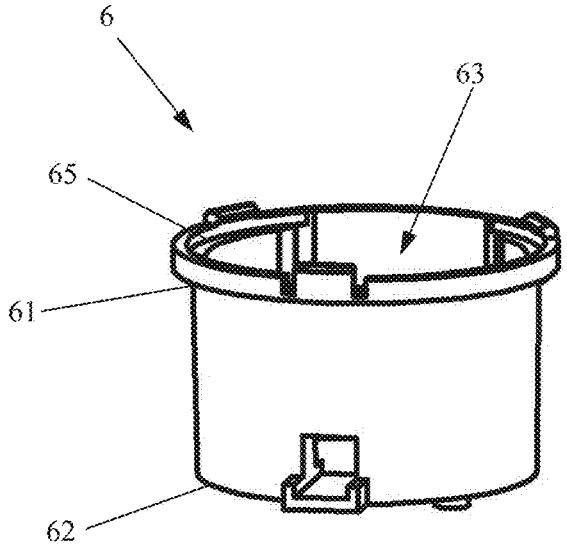
FIG. 4 is a perspective view showing a reflector of the speaker lamp according to the embodiment of the present application.

Specifically, as shown in FIGS. 3-4, a horizontally extended top end flange 71 is formed at a top end of the speaker 7, the top end flange 71 is placed on a corresponding accommodating part 65 formed at the upper end 61 of the reflector 6 and hermetically connected to the upper end 61 of the reflector 6, in other words, a sealed structure is formed at a connection of the speaker 7 and the reflector 6.

In addition, as shown in FIGS. 1-2, a downwards extended circumferential flange 34 is formed at the opening part 33 of the diffuser 3, wherein the circumferential flange 34 is hermetically connected to the top end flange 71 of the speaker 7. The opening end 11 of the main housing 1 may be hermetically connected with the bottom end 32 of the diffuser 3 together, in other words, a sealed structure is also formed at a connection of the diffuser 3 and the main housing 1. In view of this, the cavity in the speaker lamp 100 is formed into a sealed cavity, thereby a lot of space in the cavity may be further used to achieve the effect of the resonance cavity, so as to improve the tone quality of the speaker.

Figure 6:
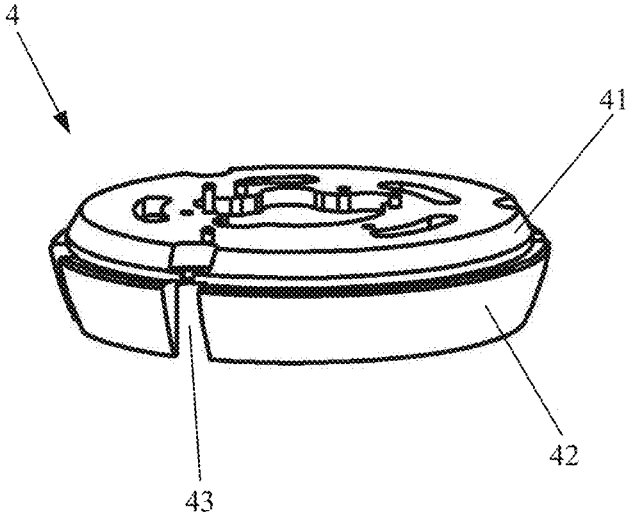
FIG. 6 is a perspective view showing a radiator of the speaker lamp according to the embodiment of the present application.

As shown in FIGS. 1 and 6, the radiator 4 may comprise a body part 41 and a circumferential flange 42 downwards extended from a periphery of the body part 42. The circumferential flange 42 of the radiator 4 may be snapped to an inner wall 14 of the main housing 1. For example, an outer wall of the downwards extended circumferential flange 42 may have a shape matched with a part of the inner wall of the main housing 1, thereby snapped to the inner wall 14 of the main housing 1 by means of shape matching. However, a connecting form of the radiator 4 and the main housing 1 is not limited to this.

In addition, as shown in FIGS. 1 and 5, the circuit board 5 may comprise a first through hole 52 positioned in a center of the circuit board 5 and one or more second through holes 53 arranged along the circumference of the circuit board 5. The first through hole 52 and the second through hole 53 are respectively positioned inside and outside of the reflector 6 and separated by the reflector 6, wherein a communication channel P which is used for communicate the first through hole 52 with the second through hole 53 is provided in the body part 41 of the radiator 4, so that the space 64 within the reflector cavity 63 is communicated to the upper cavity 131. Specifically, as shown by an arrow in FIG. 1, by means of the arrangement of the first through hole 52, the second through hole 53 and the communication channel P, the communication of the space 64 with the upper cavity 131 can be achieved. By means of such arrangement, the volume of the resonance cavity is increased so as to provide a better tone quality.

According to a preferable embodiment, the first through hole 52 is arranged at a center of the circuit board 5, the LED light source 51 is arranged at a radial outermost side of the circuit board 5, and the second through hole 53 is arranged in a radial direction between the first through hole 52 and the LED light source 51.

In addition, as shown in FIG. 6, penetration through holes 43 may be provided in the circumferential flange 42 of the body part 41 for communicating the upper cavity 131 with the lower cavity 132. By means of such arrangement, the volume of the resonance cavity may be further increased so that the speaker 7 may generate a better tone quality. According to the preferable embodiment, at a connection of the body part 41 and the circumferential flange 42, a diameter of the body part 41 is less than a diameter of the circumferential flange 42 so as to form a stepped part, and the penetration through hole 43 may be formed in the stepped part, so that the communication of the upper cavity 131 with the lower cavity 132 can be achieved better by means of the penetration through hole 43, so as to increase a total volume of the resonance cavity.

In addition, as shown in FIGS. 1-2, the speaker lamp 100 may further comprise a power supply board 8, and the power supply board 8 is accommodated in a space surrounded by the circumferential flange 42 of the radiator 4, wherein a power supply 81 for supplying power to the speaker 7 is provided at a first side of the power supply board 8.

In addition, the speaker lamp 100 may further comprise an insulating gasket 9, and the insulating gasket 9 is accommodated in a space surrounded by the circumferential flange 42 of the radiator 4 and positioned between the body part 41 and a second side of the power supply board 8 at which the power supply 81 is not installed, so that the power supply board 8 is electrically insulated with the radiator 4.

In addition, the speaker lamp 100 may further comprise a heat sink 10, and the heat sink 10 may be positioned within the lower cavity 132 and connected to the first side of the power supply board 8, so that heat radiation of the power supply board 8 is promoted.

In addition, the speaker lamp 100 may further comprise a module board **8*a* and an antenna 8*b*, both of the module board 8*a* and the antenna 8*b* are positioned within the lower cavity 132 and connected to the first side of the power supply board 8, and the antenna 8*b* is used for receiving a signal from an peripheral device (such as a mobile phone, a computer or the like) and transmitting the signal to the module board 8*a* so as to control the speaker 7**.

Figure 7:
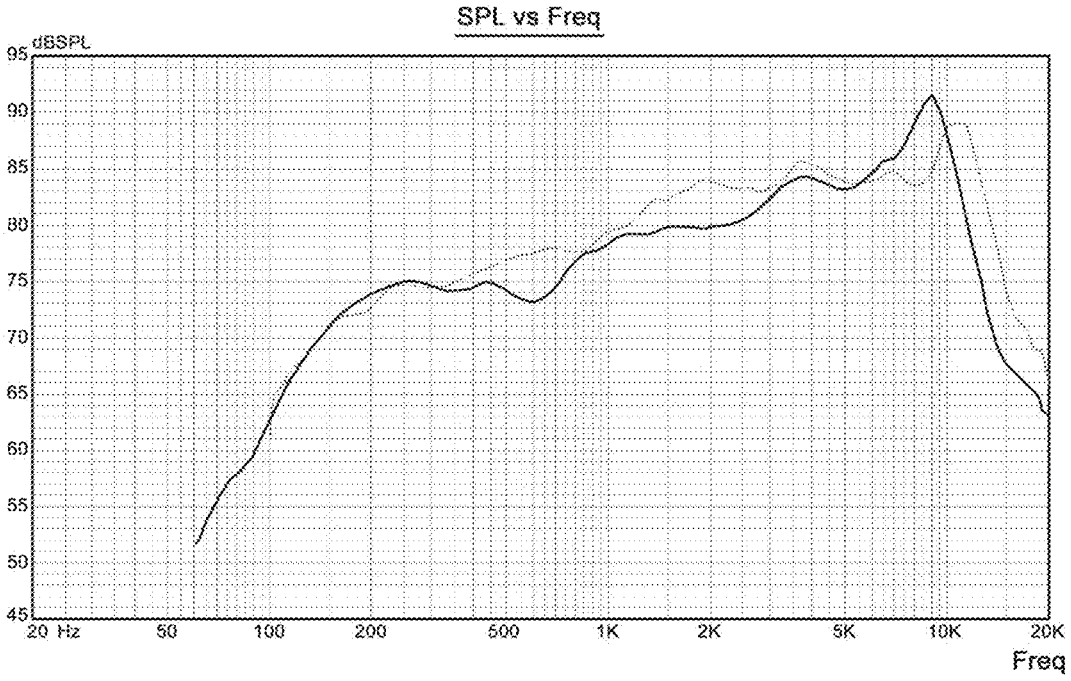
FIG. 7 is a graph of a relationship of SPL and frequency of the speaker lamp according to the embodiment of the present application compared with a conventional speaker lamp.

By reference to FIG. 7, FIG. 7 is a graph of a relationship of sound pressure level (SPL) and frequency of the speaker lamp 100 according to the embodiment of the present application compared with a conventional speaker lamp. A dashed curve in FIG. 7 shows the SPL of the speaker lamp 100 according to the present application at different frequency, and a solid curve in FIG. 7 shows the SPL of the conventional speaker lamp without the through holes in the reflector and the circuit board at the different frequency.

It may be seen from FIG. 7 that, compared with the conventional speaker lamp, the speaker lamp 100 according to the embodiment of the present application has a better SPL at the high frequency, thereby achieve a better tone quality. Furthermore, at the overall frequency, the SPL of the speaker lamp 100 according to the embodiment of the present application is more stable, thereby the overall tone quality level is also improved.

According to another embodiment modification which is not shown, a speaker lamp may comprise: a base which is connected with an external power supply, so as to provide electric power required by the speaker lamp; an outer case which is provided on the base; a circuit board; a reflector; and a speaker. The circuit board is installed within the outer case, and a plurality of LED light sources are provided on the circuit board. The reflector may be cylinder-shaped, one end of which is installed on the circuit board and the other end of which is mutually cooperated with an opening formed on the outer case, so as to form a first space positioned within the reflector and a second space positioned between the reflector and the outer case, wherein the LED light sources are positioned in the second space and reflect the light emitted from the LED light sources to external space by the reflector. The speaker may be installed on the reflector and partially accommodated in the first space. A through hole is formed in the circuit board positioned in the first space and the second space, so that the first space is communicated with the second space to form a communicated sound cavity.

The above are only the preferable embodiments of the present application, and are not intend to limit the present application. Various changes and variations may be made to the present application by those skilled in the art. Within spirits and principles of the present application, any made modifications, equivalent replacements, improvements and the like shall fall within a scope of protection of the present application.

What is claimed is:

1. A speaker lamp, comprising:

a housing formed with a cavity therein;

a radiator provided within the cavity and dividing the cavity into an upper cavity and a lower cavity;

a circuit board provided within the upper cavity and connected to the radiator, and LED light sources provided on the circuit board;

a reflector having an opened upper end and an opened lower end and hollowed so as to surround a reflector cavity, the lower end of the reflector connected to the circuit board, and the LED light sources surrounding an outer side of the reflector; and a speaker installed at the upper end of the reflector and accommodated within the reflector cavity, wherein within the reflector cavity, a space exists between the speaker and the circuit board, wherein the circuit board comprises a first through hole positioned in a center of the circuit board and one or more second through holes arranged along the periphery of the circuit board, and the first through hole and the second through holes are respectively positioned inside and outside of the reflector and separated by the reflector, wherein a communication channel for communicating the first through hole and the second through hole is provided in the body part of the radiator, so that the space within the reflector cavity is communicated to the upper cavity.

2. The speaker lamp as claimed in claim 1, wherein an opening part corresponding to the speaker is provided on the housing, so that sound from the speaker may be transmitted towards the exterior of the speaker lamp via the opening part.

3. The speaker lamp as claimed in claim 1, wherein the housing comprises:

a main housing has an opening end and an assembling end opposite to the opening end;

a base is connected at the assembling end of the main housing; and a light transmitting diffuser has a top end and an opened bottom end, and the bottom end of the diffuser is connected with the opening end of the main housing, wherein an opening part corresponding to the speaker is provided at the top end of the diffuser, so that the sound from the speaker can be transmitted towards the exterior of the speaker lamp via the opening part.

4. The speaker lamp as claimed in claim 3, wherein a horizontally extended top end flange is formed at a top end of the speaker, the top end flange is placed on a corresponding accommodating part formed at the upper end of the reflector and hermetically connected to the upper end of the reflector.

5. The speaker lamp as claimed in claim 4, wherein a downwards extended circumferential flange is formed at the opening part of the diffuser, wherein the circumferential flange is hermetically connected to the top end flange of the speaker.

6. The speaker lamp as claimed in claim 5, wherein the opening end of the main housing is hermetically connected with the bottom end of the diffuser together, so that the cavity within the speaker lamp is formed into a sealed cavity.

7. The speaker lamp as claimed in claim 3, wherein the radiator comprises a body part and a circumferential flange downwards extended from a periphery of the body part, and the circumferential flange of the radiator is snapped to an inner wall of the main housing.

8. The speaker lamp as claimed in claim 7, wherein a penetration through hole for communicating the upper cavity with the lower cavity is provided in the circumferential flange of the body part.

9. The speaker lamp as claimed in claim 7, wherein the speaker lamp further comprises a power supply board which is accommodated in a space surrounded by the circumferential flange of the radiator, wherein a power supply for supplying power to the speaker is provided at a first side of the power supply board.

10. The speaker lamp as claimed in claim 9, wherein the speaker lamp further comprises an insulating gasket which is accommodated in the space surrounded by the circumferential flange of the radiator and positioned between the body part and a second side of the power supply board at which the power supply is not installed.

11. The speaker lamp as claimed in claim 9, wherein the speaker lamp further comprises a heat sink which is positioned within the lower cavity and connected to the first side of the power supply board.

12. The speaker lamp as claimed in claim 9, wherein the speaker lamp further comprises a module board and an antenna which are positioned within the lower cavity and connected to the first side of the power supply board, and the antenna is used for receiving a signal and transmitting the signal to the module board so as to control the speaker.

13. A speaker lamp, comprising:

a base connected with an external power supply, so as to provide electric power required by the speaker lamp;

an outer case provided on the base;

a circuit board provided within the outer case, and a plurality of Light Emitting Diode (LED) light sources provided on the circuit board;

a cylinder-shaped reflector, one end of which is installed on the circuit board and the other end of which is mutually cooperated with an opening formed on the outer case, so as to form a first space positioned within the reflector and a second space positioned between the reflector and the outer case, the LED light sources positioned within the second space and reflecting the light emitted from the LED light sources to external space by the reflector; and a speaker installed on the reflector and partially accommodated within the first space, wherein the circuit board comprises a first through hole positioned in a center of the circuit board and one or more second through holes arranged along the periphery of the circuit board, and the first through hole and the second through holes are respectively positioned inside the first space of the reflector and the second space positioned between the reflector and the outer case, wherein a communication channel for communicating the first through hole and the second through hole is provided so that the first space within the reflector is communicated to the second space positioned between the reflector and the outer case.

14. The speaker lamp as claimed in claim 13, wherein an opening part corresponding to the speaker is provided on the outer case, so that sound from the speaker may be transmitted towards the exterior of the speaker lamp via the opening part.

15. The speaker lamp as claimed in claim 13, wherein the outer case comprises:

a main housing has an opening end and an assembling end opposite to the opening end with the base connected at the assembling end of the main housing; and a light transmitting diffuser has a top end and an opened bottom end, and the bottom end of the diffuser is connected with the opening end of the main housing, wherein an opening part corresponding to the speaker is provided at the top end of the diffuser, so that the sound from the speaker can be transmitted towards the exterior of the speaker lamp via the opening part.

16. The speaker lamp as claimed in claim 15, wherein a horizontally extended top end flange is formed at a top end of the speaker, the top end flange is placed on a corresponding accommodating part formed at the upper end of the reflector and hermetically connected to the upper end of the reflector, wherein a downwards extended circumferential flange is formed at the opening part of the diffuser, wherein the circumferential flange is hermetically connected to the top end flange of the speaker.

17. The speaker lamp as claimed in claim 16, further comprising a radiator that comprises a body part and a circumferential flange downwards extended from a periphery of the body part, and the circumferential flange of the radiator is snapped to an inner wall of the main housing, wherein the outer base comprises a cavity and the radiator divides the cavity into an upper cavity and a lower cavity.

18. The speaker lamp as claimed in claim 17, wherein a penetration through hole for communicating the upper cavity with the lower cavity is provided in the circumferential flange of the body part.

19. The speaker lamp as claimed in claim 17, wherein the speaker lamp further comprises a power supply board which is accommodated in a space surrounded by the circumferential flange of the radiator, wherein a power supply for supplying power to the speaker is provided at a first side of the power supply board, wherein optionally the speaker lamp further comprises an insulating gasket which is accommodated in the space surrounded by the circumferential flange of the radiator and positioned between the body part and a second side of the power supply board at which the power supply is not installed, and wherein optionally the speaker lamp further comprises a heat sink which is positioned within the lower cavity and connected to the first side of the power supply board.

20. The speaker lamp as claimed in claim 19, wherein the speaker lamp further comprises a module board and an antenna which are positioned within the lower cavity and connected to the first side of the power supply board, and the antenna is used for receiving a signal and transmitting the signal to the module board so as to control the speaker.

* * * * *